US005820500A

United States Patent [19]

Raos

[11] Patent Number: 5,820,500

[45] Date of Patent: Oct. 13, 1998

[54] NON-ROTATING RACQUET AND STRINGING MACHINE AND METHOD

[76] Inventor: Davor Raos, 2151 Riviera Dr., Vista, Calif. 92084

[21] Appl. No.: 425,318

[22] Filed: Apr. 14, 1995

Related U.S. Application Data

[63] Continuation-in-part of Ser. No. 237,390, May 3, 1994, abandoned.

[51] Int. Cl.[6] ..... A63B 51/14

[52] U.S. Cl. ..... 473/557; 473/556

[58] Field of Search ..... 273/73 R, 73 A; 473/555, 556, 557

[56] References Cited

U.S. PATENT DOCUMENTS

| | | | |
|---|---|---|---|
| 2,023,641 | 12/1935 | Morton | 273/73 A |
| 4,249,732 | 2/1981 | Balaban | 273/73 A |
| 4,326,713 | 4/1982 | Balaban | 273/73 A |
| 4,348,024 | 9/1982 | Balaban | 273/73 A |
| 4,366,958 | 1/1983 | Bosworth | 273/73 A |
| 4,417,729 | 11/1983 | Morrone | 273/73 A |
| 4,706,955 | 11/1987 | Ngadi et al. | 273/73 A |
| 5,026,055 | 6/1991 | Longeat | 273/73 A |
| 5,186,459 | 2/1993 | Korte-Jungermann | 273/73 A |
| 5,186,505 | 2/1993 | Chu | 273/73 A |
| 5,299,462 | 4/1994 | Key | 473/556 X |

OTHER PUBLICATIONS

The Stringer's Digest, 1987, and USRSA Certification Study Guide, (MacGregor), Bergelin LongString, pp. 78 and 79.

"MacGregor Bergelin Longstring", The Stringer's Digest –1987, pp. 78–79.

*Primary Examiner*—Raleigh W. Chiu

*Attorney, Agent, or Firm*—Timothy J. King

[57] ABSTRACT

A racquet stringing machine which accomplishes tensioning of the strings of a racquet by the use of one or more combination tensioning and holding clamp units which operate directly on the string inside the racquet. The present invention also provides fixed, non-rotating racquet head frame holding fixture holds the racquet stationary throughout the stringing process. The racquet is supported against distortion by compressive mounts disposed along the outer perimeter of the racquet head frame only. The racquet stringing machine further includes an offset pedestal which stabilizes the machine by counterweight effect while keeping the floor beneath the racquet holding fixture free of obstruction.

15 Claims, 4 Drawing Sheets

NON-ROTATING RACQUET AND STRINGING MACHINE AND METHOD

This is a continuation-in-part of application Ser. No. 08/237,390, filed May 3, 1994, now abandoned.

BACKGROUND OF THE INVENTION

1. Field of the Invention

The present invention relates to string installation machines for conventional tennis racquets and the like.

2. Description of the Related Art

Previous racquet stringing machines all share a fundamentally similar system of operation and all share several basic structural components. The prominent structural features of these machines are:

(a) A non-planar racquet head frame holding fixture rotationally mounted on a support. The racquet head frame holding fixtures of conventional machines consist of a rotating, cradle-like fixture such as those described in U.S. Pat. No. 5,080,360 to Longeat (1992) and U.S. Pat. No. 5,090,697 to Lee (1992). FIG. 4 details the essential components of the conventional racquet head frame holding fixture. A vertical axle and bearing serve as a pivot upon which is mounted and journals a flat-surfaced, table-like member 96. Two vertical supports 98 extend up from table 96 to support two semi-annular racquet supporting arms 100 which hold the racquet frame. Variations have been proposed to the basic fixture design described above. For example, U.S. Pat. No. 4,348,024 to Balaban (1982) discloses a ring in the place of these two semi-annular racquet supporting arms 100 for the purpose of increasing rigidity of the cradle and therefore reducing clamp deflection and racquet distortion. However, all heretofore known racquet head frame holding fixtures are non-planar, i.e., three-dimensional, cradle-like fixtures swivel-mounted on a support, which require the operator to continually adjust the angular position of the fixture and the racquet mounted thereupon during the stringing operation.

(b) Logically interrelating with the rotating fixture described above is the tensioning component of conventional machines, which consists of, as shown in FIG. 4, a tensioner 84 located and operating externally to the racquet head frame and a separate pair of string holding clamps 86 operating inside the open area of a racquet head frame. The conventional design solution to the problem of stringing is thus to rotate the racquet frame relative to a fixed external tensioning device.

(c) A further component of conventional machines which works in concert with the entire design system is a pedestal 94, as shown in FIG. 4, comprising a tripod or quadripod centered under the stringing head. The rotating racquet operating principle upon which conventional machines are based requires standing operation; thus the floor area beneath the stringing head does not have to be free of pedestal structure in order to accommodate a seated human.

(d) Finally, previous machines include an anti-distortion mounting system which includes a pair of supports 88 inside the racquet frame, and a plurality of anti-expansion side supports 90.

Although the conventional type of stringing apparatus described above can satisfy the basic need, it is subject to one or more of the following disadvantages:

1. Tension Inaccuracy

Previous tennis racquet stringing machines cannot consistently achieve a precise desired tension or the uniformity of tension required for optimal performance of a racquet. Inaccurate control over tension is a result of the design of the previous tensioning and clamping system. Prior art machines are designed with a tension metering device located externally to the racquet head frame and a pair of string tension retaining clamps located inside the open area of a racquet head frame. Racquets strung on previous racquet stringing machines have a net installed string tension that is less than the metered input tension due to slippage and deflection in the machines' string tension retaining clamps. The string tension load induced in each string by the external tension metering device is transferred to the tension retaining clamp structure, which anchors the string while the tension metering device is employed to tension the next string. However, after the tension has been metered and the load transferred, slippage and deflection occur in the tension retaining clamp and associated structure. Therefore, the passive clamp structure cannot retain the original metered tension level in the string. Even relatively minute amounts of deflection and slippage in the passive tension retaining clamp assembly can cause significantly large tension losses in the string.

This tension loss is variable and difficult to control and causes installed string tension to vary from string to string and from racquet to racquet, irrespective of the degree of accuracy of the tension metering device. For example, if the initial tension metered by previous machines is sixty pounds, the racquet is commonly termed to be strung at "sixty pounds". However, the actual net installed tension may be in the range of twenty-five to thirty-five pounds—the range being due to variable losses at the clamp. Previous machines thus do not consistently yield one outcome for any one specific initial tension metered, but a range of possible outcomes.

This variability of losses at the clamp constitutes a repeatability error and accounts for the tension inaccuracy of previous machines. This tension variability forces a player to deal with varying tensions from string job to string job. Such inconsistencies in equipment can frustrate a player's efforts to hone a consistent playing form since a racquet responds differently at different tension levels.

Furthermore, previous machines cannot achieve a uniformly-tensioned string bed. The resultant random fluctuations in tension across the string bed of the racquet reduce the accuracy of shot making because the ball rebounds erratically from an unevenly tensioned string bed. These tension fluctuations can therefore have a significant, negative impact on player performance in a game like tennis where consistency is a major key to success.

2. String Overstress

Another area of difficulty is the overstress previous machines subject the string to during the stringing process. In order to compensate for the inevitable slippage and deflection in the tension retaining clamp, previous machines must draw the string to an excessively high initial tension in order to approximate the desired installed final tension. For example, if the initial tension metered by previous machines is sixty pounds, the racquet is commonly termed to be strung at "sixty pounds". However, the actual installed tension may be approximately thirty pounds—the difference being due to the loss at the clamp. The high initial tension thus necessarily imparted to the string damages the string by excessively elongating it.

Prior art machines also invite compressive damage to the strings because the experienced operator tends to employ excessive clamping pressure as the only means available to him or her on the previous machines to forestall slippage and associated tension loss. However, this effort to prevent slippage is not an efficient defense against tension loss since it results in crushing the string. Thus, a major disadvantage of prior art machines is a significant reduction in the strength, playability, and useful life of the string.

3. Rotating Racquet System

Integral to the design of prior art machines is a rotating racquet operating system which greatly reduces operator efficiency. In all previous racquet stringing machine designs, the tension metering device is positioned on the machine externally to and at a distance from the racquet head frame. The racquet and the entire racquet head holding fixture must therefore be rotated on a pivot to align the string exit holes on the racquet with the tension metering device in order to tension each string. An approximately 180° turn of the racquet and racquet head holding fixture is required for each string tensioning and clamping cycle.

Limitations of this rotating design include that the operator must remain standing—or must continually interrupt the job to stand up—in order to move his or her body away from the machine to let the racquet handle pass when the racquet is rotated. Standing operation not only can result in operator fatigue, but also compels frequent, wasteful, peripheral movement of the entire body that is not pertinent to the stringing process. The operator must continually adjust the angular position of the racquet head holding fixture and, typically, set and release a manual hand brake necessarily provided on many conventional machines to arrest rotation during tensioning. The continual rotation of the racquet also creates operator disorientation because it changes the position of the racquet face relative to the operator every cycle. The movement of the racquet incessantly interrupts the smooth rhythm of operation and requires frequent mental adjustment and reorientation. Pivoting racquet stringing machines thus reduce operator efficiency by necessitating standing operation, requiring superfluous motion, and producing operator disorientation.

4. Limited Working Accessibility

The structural design of all previous racquet stringing machines limits space beneath the racquet face and therefore hinders working access to the stringing plane. The rotating racquet system necessitates a pivot structure beneath the racquet face which impedes free movement of the operator's hands during the stringing process. Working accessibility and thus operator speed is hampered by the non-planar, three-dimensional characteristic of conventional racquet head frame holding fixtures. Clamps mounted on guide rails below the racquet plane crowd the working space further. One design, disclosed in U.S. Pat. No. 4,348,024 to Balaban (1982), by adding bulk and rigidity to the conventional apparatus in order to minimize deflection in the clamping system, gains an increase in tension accuracy only at the expense of a further reduction in working clearance. These obstructions to hand movement result in injured knuckles and limit the speed, ease, and comfort with which a racquet may be strung.

5. Complex String Installation Process

In previous machines, the rotating racquet system requires that each string must be both individually threaded loosely into the racquet head and tensioned before the next string can be installed. It is not practicable to thread the entire string bed into the racquet head frame first and subsequently tension each string. This time-consuming requirement limits the speed and efficiency with which the stringing process may be completed.

6. Inefficient Mounting System

Previous racquet mounting systems inefficiently solve the problem of racquet frame deformation encountered during string installation. Due to the flexibility of racquet frames, a racquet mounting system of a stringing machine must counter the deformation inducing load of the main strings (which are customarily installed first) until the cross strings are installed. Previous machines attempt to meet this requirement by the use of two internal supports at the yoke and distal ends of the racquet and several (four to six) external supports at the sides. In practice, it is the internal supports on previous machines that receive most of the load. The net effect of the conventional mounting system is therefore to resist at two end points the main strings from pulling the yoke and distal ends of the racquet frame inwards.

However, racquet frames are designed to balance the tension load of the main strings with cross string tension, as can be seen in a completely strung racquet. Therefore, racquet frames would be most efficiently supported against deformation during main string installation by distributed compressive support at the sides of the racquet, which would duplicate during stringing the load pattern for which a racquet is designed.

Due to operator inefficiency, tension inaccuracy, string overstress, an inefficient mounting system, and the other attendant problems discussed above, prior art machines offer an inefficient mechanical solution to the problem of racquet stringing.

SUMMARY OF THE INVENTION

The object of the present invention is to provide efficient solutions to the problems encountered with prior art stringing machine designs. Accordingly, the present invention approaches the problem of stringing from a new perspective and proposes a stringing system differing substantially from the conventional system. The basic structural components of the present invention are:

(a) A fixed, non-rotating, substantially planar racquet head frame holding fixture. Two results should be noted from this basic component: one, the structure has been simplified, and two, the method of operation has been changed. FIG. 1 shows the relative simplicity of the non-rotating fixture of the present invention compared with the rotating fixture shown in Prior Art FIG. 4. Conspicuously absent from the present invention design are the axle and bearing, the table-like member 96, and the vertical supports 98, present in prior art FIG. 4. The method of operating the present invention differs from conventional methods in that the operator is not required to continually adjust the angular position of the fixture.

(b) A tensioning system comprised of at least one combination tensioning and holding clamp units operating inside the open area of a racquet head frame directly on the length of string being installed. The tensioning and holding operations have been subsumed into one unit. A unit may move relative to a fixed racquet frame in order to operate on successive strings, rather than the previous solution of rotating the racquet relative to a fixed external tensioning device.

(c) A pedestal comprising a substantial counterweight that is offset to one side of the column support so as to leave the floor area beneath the stringing head devoid of pedestal structure. The non-rotating racquet operating principle makes seated operation feasible; thus the pedestal is designed to accommodate a seated human.

(d) An anti-distortion mounting system comprised of external compressive supports only.

These structural components operate in concert to yield many important advantages in stringing. Objects and advantages of the present invention include a substantial increase in tension accuracy and operator efficiency, the elimination of string overstress and an improved mounting system, and other objects and advantages to be made evident in the discussion that follows.

1. Tension Accuracy

The present invention gives the operator greatly improved control over net installed string tension compared to the prior art. This improvement is due to the use of a novel tensioning and clamping system which eliminates the tension loss associated with previous tensioning and clamping systems. In the present invention, a combination tensioning and clamping unit, operating directly on the string inside the open area of a racquet head frame, both draws the string to the desired tension and holds it at that tension. There is no transfer of string tension load from a dynamic tension metering device located outside the racquet frame to a separate, passive tension retaining clamp, as in previous machines. Instead, one unit, operating inside the open area of a racquet head frame, both imparts tension to the string and holds it at that tension. Thus, there is no tension loss such as that incurred by previous machines as the tension load is transferred to a passive string tension retaining clamp structure which deflects under the tension of the string. Rather, the net installed string tension in the racquet is exactly the tension metered by the combination tensioning and clamping unit in accordance with desired input tension. One of the combination units may be used with a passive clamp to operate on a single string at a time. Preferably, two of these combination tensioning and clamping units are used alternately to operate on successive strings. Thus, more accurate control over net installed tension is achieved in the present invention due to an improved system for tensioning and clamping the string.

The increased control over net installed string tension made possible by the present invention significantly improves racquet performance. Because the present invention yields more uniform tension from string to string across the racquet face, racquets strung on this apparatus facilitate greater control over the direction of a player's shots. Also, since tension can be exactly duplicated from one string job to another, players can play with the same tension over a longer period of time, which assists them in their efforts to develop a consistent playing form. Thus, the increased control over net installed tension provided by the present invention optimizes racquet performance.

2. Elimination of String Overstress

The novel tensioning and clamping system discussed above not only improves tension accuracy but also simultaneously results in other advantages. One such advantage is the elimination of the string overstress and the attendant damage that are undesirable by-products of prior art machines. Since the present invention does not lose tension through the transferral of the tension load to a passive clamping device, it does not need to compensate for inevitable tension loss by pulling the string to an excessively high initial tension as prior art machines do. The string is never pulled beyond the desired tension and it is thus not subjected to the excessive elongation which weakens the string on prior art machines. Also, since it is unnecessary for operators to apply excessive force to the clamp in order to forestall slippage, the string is not crushed. With the use of the present invention, strings retain more of their original resiliency and strength through the stringing process; thus, the "feel" of the strings in play is improved and their useful life is extended.

Furthermore, the elimination of string overstress makes it more feasible than ever before to use light gauge string. Light gauge string is generally recognized to provide better response in play but heretofore was impractical for most players to use due to the relative lack of durability of light gauge string after being subjected to the overstress imposed by prior art machines. Since heavy gauge string was relatively much more durable under these conditions, light gauge string was prohibitively expensive for the average player to use. With the use of the present invention, more players can take advantage of the better qualities of light gauge string, since the same durability that was previously delivered by heavy gauge string will now be possible to achieve with a thinner string.

The present invention's elimination of string overstress thus translates into undamaged strings that respond better in play and into increased string durability, which enables more players to benefit from light gauge strings.

3. Non-rotating Racquet System

A salient design feature of the present invention and a principal point of departure from prior art lies in the fixed, non-rotating racquet head holding fixture of the present invention. This fundamental difference in design originates in the new tensioning and clamping system. Because the tension metering device is not positioned at a distance from and outside the racquet head frame as on prior art machines, the racquet is not required to rotate every tensioning and clamping cycle in order to align the string exit holes on the racquet with the tensioning head. Rather, since the new tensioning and clamping system design comprises at least one combination tensioning and clamping units operating inside the open area of a racquet head frame, the racquet and racquet head holding fixture remain fixed throughout the stringing process.

The advantages of this non-rotating design lie in the elimination of the obstacles to operator efficiency associated with the rotating racquet system of prior art. First, the non-rotating design allows the operator to be seated throughout the stringing process, since the racquet handle does not pass between the operator and the machine once every stringing cycle. Seated operation reduces fatigue and eliminates the wasteful, non-pertinent body movement that is an inevitable part of operating previous machines. Rather than requiring such superfluous movement, the present invention makes only hand movement necessary. Secondly, operator disorientation is eliminated with the non-rotating racquet system because the relative position of the racquet face to the operator never changes. The operator can maintain a fixed, unchanging point of reference, which facilitates efficient operation, without the constant interruption of concentration and mental orientation caused by the rotating racquet system. Finally, the floor space required for the stringing machine and the stringing process is reduced in the present invention because the racquet handle does not swing. The advantages of the non-rotating racquet system thus include a significant increase in operator efficiency as well as the practical advantage of a decrease in the space required for stringing.

4. Improved Working Accessibility

The present invention also substantially increases operator efficiency by providing completely unobstructed access to the underside of the racquet face. The racquet head frame holding fixture is substantially planar in form as opposed to the cradle-like fixtures integral to prior art machines which impede hand movement around the mounted racquet. Unlike the rotating racquet system of previous machines, the non-rotating racquet system obviates the need for a central pivot directly below the racquet face. The area beneath the racquet face is further kept clear by a pedestal design that is offset to one side of the column support and which thus works in concert with the non-rotating racquet system to allow for increased working accessibility and seated operation. Also, the tensioning and clamping structure used on the present invention impedes working access less because it is smaller than the clamping structure of prior art machines and because it intrudes only at the edges of the racquet face.

Most importantly, the present invention does not attain its high degree of tension accuracy at the expense of working clearance. In contrast, some more recent prior art designs only achieve greater tension accuracy over earlier designs at the expense of additional bulk and reduced working clearance. For example, U.S. Pat. No. 4,348,024 to Balaban (1982) describes a conventional stringing apparatus with the novel addition of an annulus to provide more rigid support for the conventional passive clamps and therefore reduce clamp deflection under load. However, while this method of minimizing clamp deflection improved the tension accuracy of the standard design of stringing apparatus, it also exacerbated the problem of bulk and limited working clearance. A trade-off therefore exists in prior art racquet stringing machine systems between accessibility and tension accuracy. The present invention, on the other hand, achieves heretofore unsurpassed accuracy in tension while simultaneously maximizing working accessibility.

Without impediments to free hand movement beneath the racquet plane, the present invention significantly increases the speed, ease, and comfort with which a racquet may be strung.

5. Simplified String Installation Process

Another feature of the present invention conducive to operator efficiency is the streamlining of the string installation process. The present invention makes possible a separation of the two tasks central to racquet stringing: threading the string into the racquet and tensioning the string. Because the tension is metered inside the racquet frame rather than outside as on prior art machines, the entire string bed may be threaded loosely into the racquet head frame before the tension metering process is begun. On previous machines, the operator must thread one string, rotate the racquet to align the string exit hole with the tension head, meter tension to that string, then repeat the process with each subsequent string. With the use of the present invention, on the other hand, the operator can first thread all the string loosely into the racquet head frame. Then, without any racquet rotation, the operator can tension the already installed string bed, one string after another, by the use of two combination tensioning and clamping devices or a single unit in combination with a passive clamp. This streamlined process allows the operator to complete the stringing job in a fraction of the time required by the use of prior art machines.

6. Improved Mounting System

The mounting system of the present invention comprises a more elegant solution to the problem of frame deformation inevitably encountered in racquet stringing. Previous machines resist deformation primarily by the use of two internal supports at the yoke and distal ends of the racquet frame. In contrast, the present invention's mounting system holds the racquet only in compression at the sides and eliminates entirely any internal supports. This system counters the tension of the main strings by duplicating the pressure of the cross strings before and until they are installed, thus loading the frame from the beginning of the stringing process in the same way that a completely strung frame is loaded. The load pattern on the frame during string installation is therefore the load pattern for which the racquet design has been optimized.

7. Ease of Disassembly, Lighter Weight, and Portability Features

A further innovative feature of the present invention is the ease with which this professional-quality machine converts to a portable model. Due to the relative simplicity of its construction, the machine disassembles easily into two units. The heavier column and base unit needed for support and stability in high-volume, professional shop operation can be detached from the stringing head unit and left behind when one desires a portable machine. The compact upper part of the machine, the stringing head, consists of relatively few and lightweight parts that can be quickly disassembled and packed in a convenient carrying case. Especially advantageous for stowage is the unique, planar design of the racquet head frame holding fixture. The portability of the present design is, of course, convenient and economical both for shipping and for travelers.

Since the racquet does not rotate in the present design, the stringing head, when detached from the column and base unit, is easily adaptable to table-top mounting or table-edge clamping. Another alternative support system for the stringing head is a fold-down wall mount, which allows the machine to be conveniently stored out of the way when not in use.

Most importantly, because the racquet frame does not rotate, the present invention is as efficient when operated in the portable mode, without the base and column unit, as it is when operated in the professional free-standing mode. Prior art, on the other hand, cannot combine portability and professional-quality results in one machine. Previous portable machines produce inferior results while previous professional machines are barred from portable use by their heavy weight, high volume, many parts, and rotating racquet design. Due to its simplicity, easy of disassembly, lighter stringing head weight, and non-rotating racquet system, the present invention is thus adaptable to various requirements, such as portability or the needs of professional shops, and operates effectively in these various modes.

Further objects and advantages of the present invention will become apparent from a consideration of the drawings and ensuing description.

REFERENCE NUMERALS IN DRAWINGS

Figure 1:
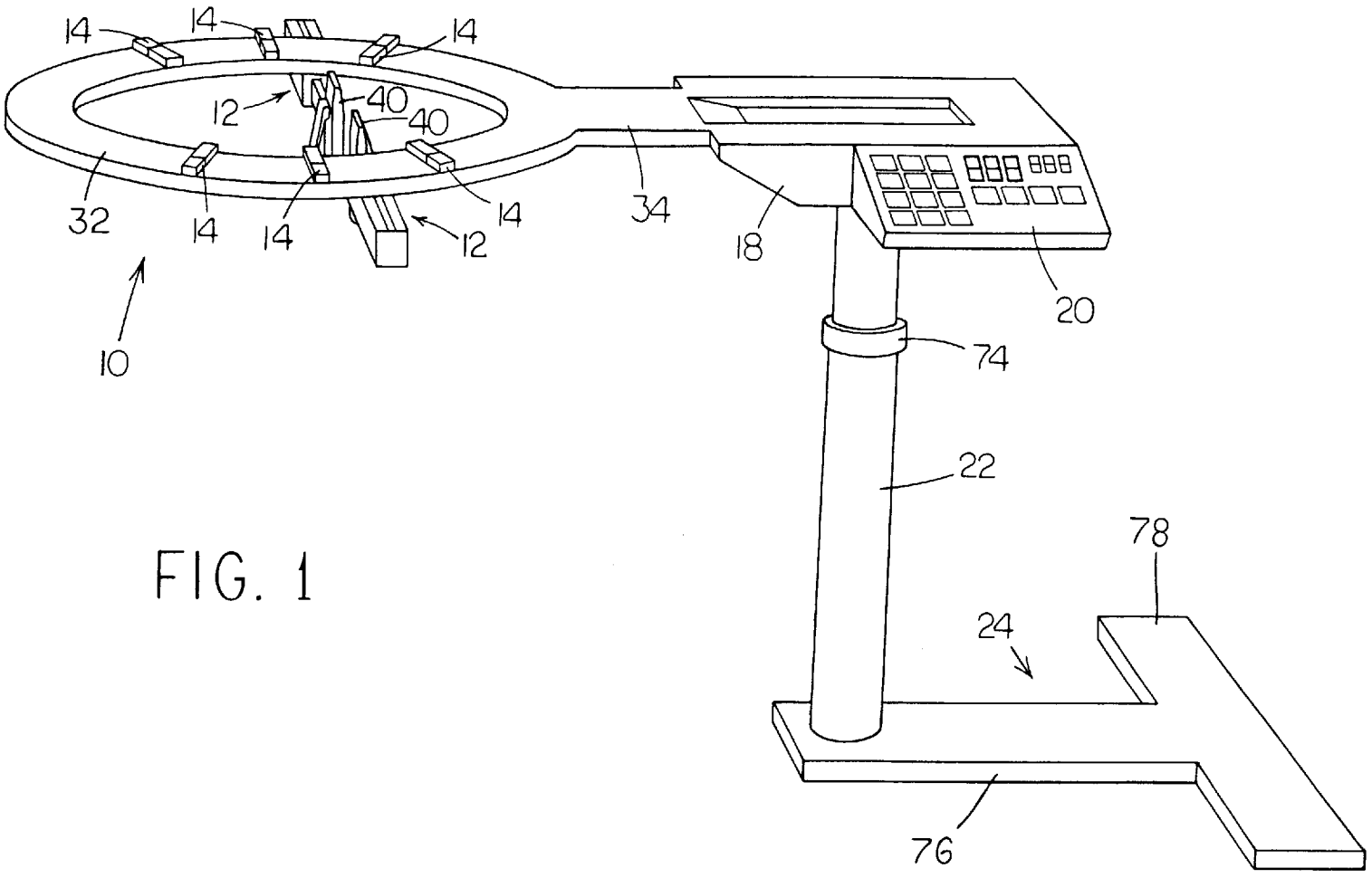
FIG. 1 shows a perspective view of a racquet stringing machine according to the present invention.

10 fixed, non-rotating racquet head frame holding fixture

12 combination tensioning and holding clamp unit

14 compressive mount
16 adjustable hold down
18 microcomputer and housing unit
20 control panel
22 support column
24 counterweight offset pedestal
26 racquet
28 racquet head frame
30 racquet handle
32 ring
34 neck extension
36 retentive subtrack
38 linear actuator
40 string clamp
42 shuttle
44 strain transducer
46 computer control button
48 pretensioner
50 horizontally reciprocating beam
52 gripping jaw
54 clamp actuating lever
56 manually operable mechanism
58 multi-conductor connection cable
60 pretensioner control switch
62 pretensioner string clamp
64 block
66 jaw
68 set screw
70 digital display
72 numeric keypad
74 circular ring clamp
76 beam
78 cross beam
80 string
82 rotating racquet head frame holding fixture
84 external tensioner
86 passive string clamp
88 internal support
90 anti-expansion side support
92 support column
94 non-offset pedestal
96 table-like member
98 vertical support
100 semi-annular racquet supporting arm

DETAILED DESCRIPTION OF THE PREFERRED EMBODIMENTS

A detailed discussion of the various embodiments of the present invention, with reference to the accompanying drawings, will illustrate the concept of the present invention and the advantages in racquet stringing arising therefrom.

An embodiment of the racquet stringing machine of the present invention comprises the following components: a fixed, non-rotating racquet head frame holding fixture 10, a single combination tensioning and holding clamp unit 12, a passive clamp 86, six compressive mounts 14, a pair of adjustable hold downs 16, a microcomputer and housing unit 18, a control panel 20, a support column 22, and a counterweight offset pedestal 24. Passive clamps 86 are well known to those of ordinary skill in the art. See FIG. 4. Use of only one combination clamp unit 12 is an embodiment of the present invention and one of ordinary skill in the art would know, utilizing the teaching set forth in this application, to practice the present invention with one passive clamp 86 and one combination clamp 12.

Figure 2:
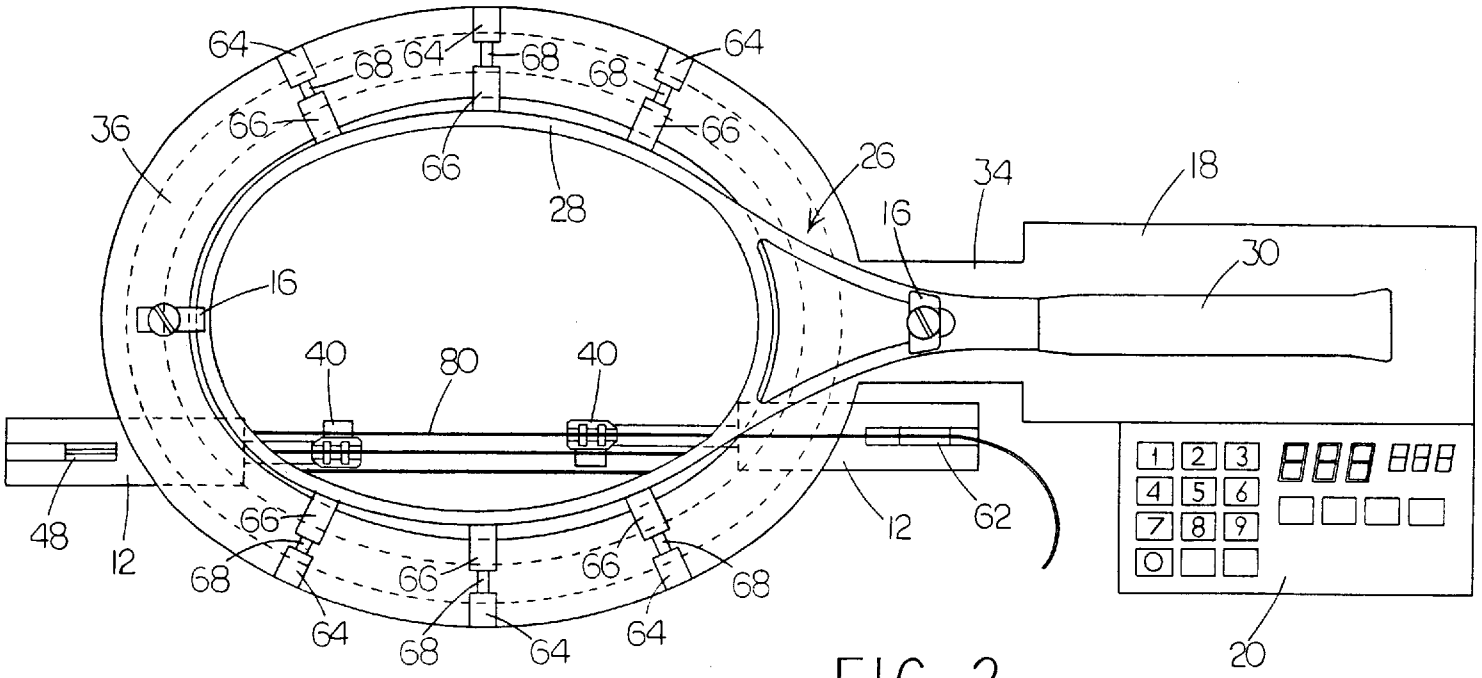
FIG. 2 shows a plan view from the top of a portion of a racquet stringing machine constructed in accordance with the present invention.

A preferred embodiment of the racquet stringing machine of the present invention is illustrated in FIG. 1 (perspective view) and FIG. 2 (plan view). In accordance with FIG. 1, a preferred embodiment comprises the following components: a fixed, non-rotating racquet head frame holding fixture 10, a pair of combination tensioning and holding clamp units 12, six compressive mounts 14, a pair of adjustable hold downs 16, a micro computer and housing unit 18, a control panel 20, a support column 22, and a counterweight offset pedestal 24.

A detailed description of each of these components of a preferred embodiment are as follows. In accordance with FIG. 2, fixture 10 comprises a ring 32 and a neck extension 34. Ring 32 has substantially flat and parallel upper and lower surfaces dimensioned to approximately circumscribe a racquet head frame 28. Ring 32 is of sufficient cross-section to yield the rigidity necessary to resist deformation loads imposed by string tension during installation and to house a retentive subtrack 36 in its lower surface. Retentive subtrack 36 is shown in FIG. 2 with a dotted line. Retentive subtrack 36 can be, for example, a dovetail slot or a T-slot.

Neck extension 34 serves to rigidly connect ring 32 to microcomputer and housing unit 18. Neck extension 34 is substantially co-planar with ring 32. In the favored embodiment shown in FIG. 1, neck extension 34 is integral with ring 32, although another embodiment of the present invention is feasible wherein neck extension 34 is a separate structure which fastens to ring 32 by means of screws. In the favored embodiment shown in FIG. 2, neck extension 34 projects from the side of ring 32 corresponding to the yoke end of racquet head frame 28 when mounted on ring 32. The shaft and racquet handle 30 end of a racquet lies on top of neck extension 31 and microcomputer and housing unit 18 and therefore racquet handle 30 does not project out from the stringing machine and impede working accessibility as on prior art machines.

The advantages of a fixed, non-rotating racquet head frame holding fixture are readily apparent from a consideration of the accompanying illustrations. Since fixture 10 is non-rotatable but rigidly fixed by neck extension 34 to microcomputer and housing unit 18, no pivot structure exists beneath fixture 10 such as in prior art machines. Fixture 10 is thus suspended over clear space and accessibility for the operator of the machine is therefore improved over prior art designs.

Figure 3:
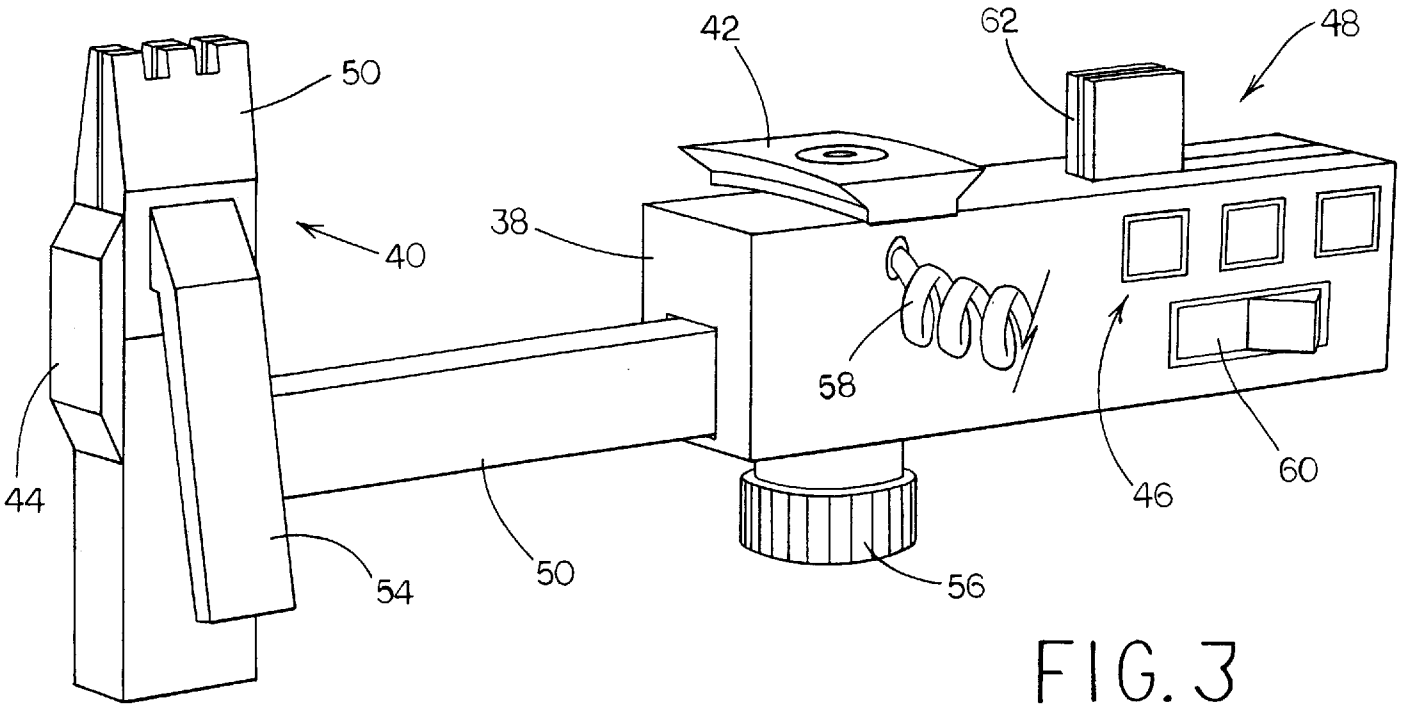
FIG. 3 shows a perspective view of a combination tensioning and holding clamp unit forming part of the present invention.

The second main component of a preferred embodiment of the present invention is the use of a pair of combination tensioning and holding clamp units 12, which yields important advantages in string tensioning. Each combination unit 12, as shown in FIG. 1 and FIG. 2, lies in closely coupled relation to fixture 10. A detailed perspective view of one of the pair of combination units 12 is shown in FIG. 3. In accordance with FIG. 3, each combination unit 12 generally comprises a linear actuator 38, a string clamp 40, a shuttle 42, a strain transducer 44, three computer control buttons 46, and a pre-tensioner 48.

In the preferred embodiment, linear actuator 38 of each combination unit 12 is an electro-mechanical linear actuator with a horizontally reciprocating beam 50, although any type of linear actuator could be used in alternative embodiments, including pneumatic, hydraulic, dropweight, spring and manual-powered linear actuators.

Each combination unit 12 further includes a string clamp 40, as shown in FIG. 3. String clamp 40 comprises a pair of opposed gripping jaws 52 adapted to receive and clamp therebetween a string 80 to be tensioned. A clamp actuating lever 54 is provided for displacing jaws 52 from and to each other. A strain transducer 44 forms part of string clamp 40 for the purpose of sensing the tension developed in the string. Located at the side of string clamp 40, strain transducer 44 senses the angular deflection of string clamp 40 under the string tension load.

String clamp 40 is connected to beam 50 of linear actuator 38 in a manner permitting vertical displacement of string clamp 40 relative to beam 50 and thus permitting string clamp 40 to be raised to engage string 80 or lowered below the level of the string bed of racquet head frame 28 to allow free travel.

As shown in FIG. 3, shuttle 42 is pivotally mounted to the top surface of linear actuator 38 of each combination unit 12. Shuttle 42 is formed to fit into retentive subtrack 36 in ring 32, such that each combination unit 12 is held in closely coupled relation to the underside of ring 32. Shuttle 42 and combination units 12 can slide freely along subtrack 36 and combination units 12 can be rotated to any angle relative to subtrack 36.

A manually operable mechanism 56, which can be a thumbscrew with rod linkage or a lever with rod linkage, is connected to shuttle 42 of each combination unit 12 and serves to displace shuttle 42 vertically relative to the body of combination unit 12 for the purpose of clamping combination unit 12 at any position along subtrack 36 and of allowing combination unit 12 to travel along ring 32 to a new position. When shuttle 42 is in the raised position relative to combination unit 12, shuttle 42 and combination unit 12 are free to slide along subtrack 36. When shuttle 42 is in the lowered position relative to combination unit 12, combination unit 12 is clamped in place on ring 32.

Computer control buttons 46 provide for operator control over the movement of linear actuator 38 of each combination unit 12 and are mounted on the external surface of the body of linear actuator 38.

Each combination unit 12 is connected to microcomputer and housing unit 18 via a multi-conductor connection cable 58.

Due to clamp interference caused by main strings, the cross strings are pre-tensioned to approximately 25% to 95% of final tension by pre-tensioner 48. The provision of a pretensioner on each combination unit 12 reduces the travel distance of string clamp 40 necessary to achieve desired tension. Electrically driven pretensioner 48 is integral with combination unit 12 and consists of a pretensioner string clamp 62 and a pretensioner control switch 60. The operation of the pretensioner control switch 60 controls the closing and opening of pretensioner string clamp 62 and the reciprocating movement of pretensioner string clamp 62. Pre-tensioner string clamp 62 is demountable from combination unit 12 to allow combination unit 12 to pass beneath neck extension 34 during the tensioning of the main strings.

The present invention also encompasses a novel mounting system for mounting racquet head frame 28 on the stringing machine. In accordance with FIG. 1, the mounting system comprises six compressive mounts 14 radially disposed along top surface of ring 32 which hold the racquet to be strung in compression at the sides. Each compressive mount 14, in accordance with FIG. 2, comprises a block 64, a jaw 66, and a set screw 68. Block 64 is rigidly affixed to the upper surface of ring 32 and is flush with the outer perimeter of ring 32. Jaw 66 is slidably mounted on ring 32 between block 64 and racquet head frame 28.

Set screw 68 turns in a threaded hole parallel with top surface of ring 32. Jaw 66 receives the end of setscrew 68, and the turning of setscrew 68 therefore moves jaw 66 transversely across ring 32 to and from racquet head frame 28 for the purpose of engaging or disengaging the outer perimeter of racquet head frame 28.

Compressive mounts 14 prevent the racquet head frame from distorting during main string installation by duplicating the effect of the cross string tension before the cross strings are installed.

A pair of adjustable hold downs 16 at the throat and distal ends of racquet head frame 28 retain racquet head frame 28 to ring 32 with downward pressure.

Another main component of the preferred embodiment of the present invention is microcomputer and housing unit 18 as shown in FIG. 1. The inside space of microcomputer and housing unit 18 encloses a microcomputer and also serves as a tool box. As before mentioned, microcomputer and housing unit 18 also serves as a mechanical interface between ring 32 and support column 22, since neck extension 34 of ring 32 is rigidly affixed to the top surface of microcomputer and housing unit 18 and microcomputer and housing unit 18 is mounted to the top of support column 22.

Microcomputer and housing unit 18 also functions as a mechanical support for control panel 20. As shown in FIG. 2, control panel 20 comprises a digital display 70 and a numeric keypad 72. Numeric keypad 72 allows the operator to input desired tension into the microcomputer. Digital display 70 shows desired tension and simultaneously shows current tension in string 80 as measured by strain transducer 44 of either combination unit 12. Control panel 20 is demountably attached to microcomputer and housing unit 18, and can be mounted on either side of microcomputer and housing unit 18 to accommodate both right- and left-handed operators.

In accordance with FIG. 1, support column 22 is a telescoping, height-adjustable, rigid tubular column. A circular ring clamp 74 is provided on support column 22 for fixing the stringing head at any height. Support column 22 is designed to feature variable height due to the possibility of seated operation introduced and made practical for the first time by the present invention's non-rotating fixture 10.

Counterweight offset pedestal 24, as illustrated in FIG. 1, is another important novel component of the present invention arising from the non-rotating theory and structure. In order to make seated operation feasible, floor space beneath the stringing machine must be free of pedestal structure. Thus, a pedestal offset from support column 22 is provided, which prevents the stringing head from tipping by counterweight effect. Pedestal 24, as shown in FIG. 1, is T-shaped and of material of sufficient weight to stabilize the machine against tipping. Pedestal 24 comprises a beam 76 parallel to the floor and extending from bottom of support column 22 in opposite direction from ring 32, and a cross beam 78 at right angles to beam 76 and rigidly connected to beam 76. Beam 76 is demountably attached to support column 22 in order to facilitate disassembly of the stringing machine for transportation.

Figure 4:
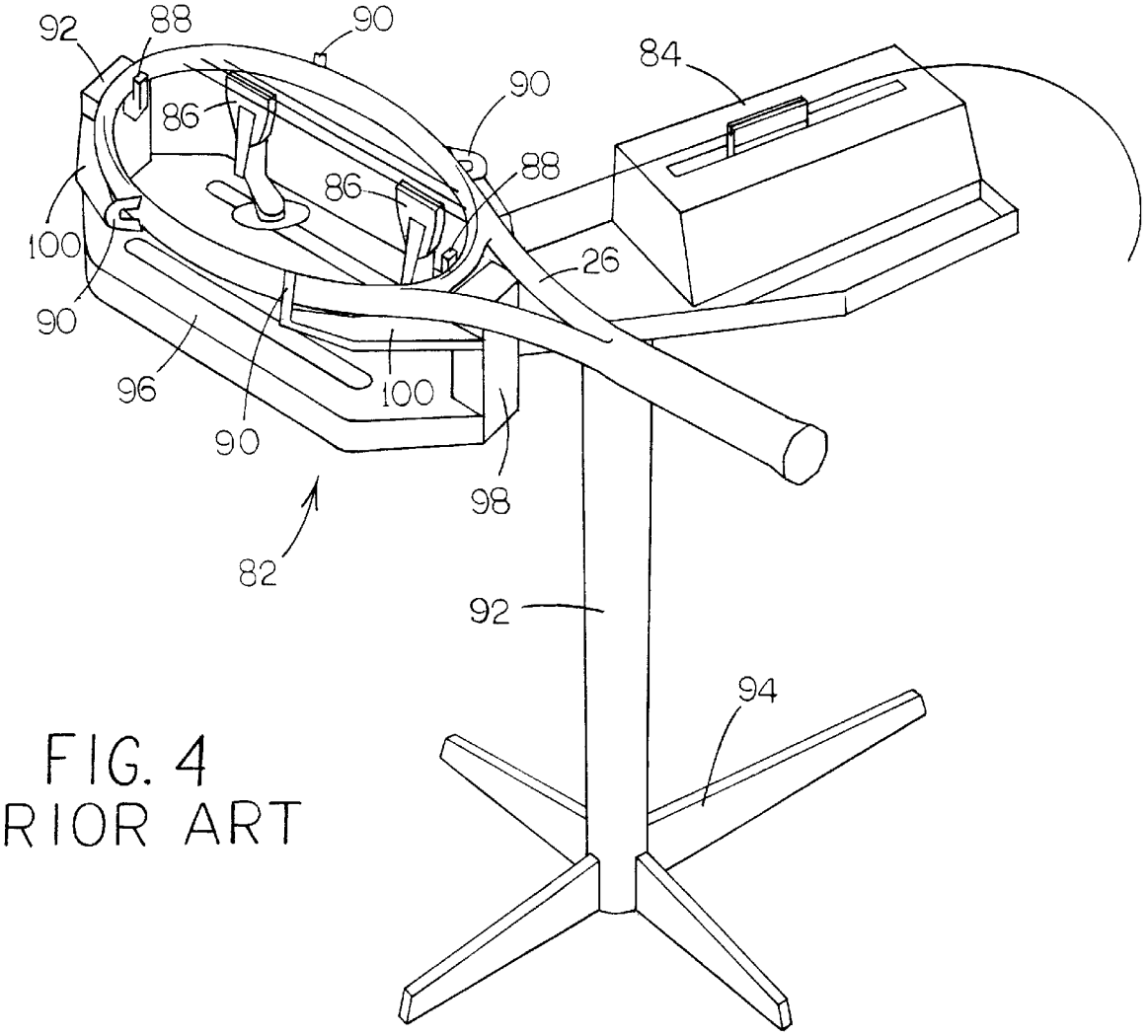
FIG. 4 PRIOR ART
FIG. 4 shows a view in perspective of a typical racquet stringing apparatus according to the prior art.

Understanding of the present invention will be enhanced by a comparison with the prior art. FIG. 4 shows a view in perspective of a typical racquet stringing apparatus according to the prior art. As shown in FIG. 4, the basic structural components of a stringing apparatus according to the prior art are: a rotating racquet head frame holding fixture 82, an external tensioner 84, a pair of passive string clamps 86, a pair of internal supports 88, a plurality of anti-expansion side supports 90, a support column 92, and a non-offset pedestal 94.

Operation—FIGS. 1, 2, 3

The manner of using the non-rotating racquet stringing machine differs substantially from the method of stringing on machines in present use. Accordingly, a step-by-step description follows of the method of racquet stringing on the preferred embodiment of the present invention.

1. First, racquet 26 is placed on fixture 10 as shown in FIG. 2, with racquet handle 30 resting on neck extension 34 and microcomputer and housing unit 18.

2. Each hold down 16 is then screwed down over racquet head frame 28 at the throat and distal ends of racquet head frame 28, as shown in FIG. 2.

3. Setscrew 68 of each compressive mount 14 is screwed in until jaw 66 of each compressive mount 14 is just compressing racquet head frame 28.

4. Next, a piece of string of sufficient length to compose the main stringbed is tied off at the manufacturer's designated starting point for the particular racquet about to be strung. Then, all main (vertical) strings are threaded loosely onto racquet head frame 28 so that a loosely woven stringbed is completely installed in racquet head frame 28 before tensioning of the main strings is begun.

5. After the main strings have been loosely installed into the string plane, the tensioning process is begun. First, desired net string tension is input at numeric keypad 72. This "target", or objective, tension will display on digital display 70.

6. Either combination unit 12 is now brought into alignment with the first string to be tensioned by manually sliding combination unit 12 along subtrack 36 and manually rotating combination unit 12 to the orientation required to operate on the string to be tensioned.

7. Combination unit 12 is then locked in place on ring 32 by operating manually operable mechanism 56.

8. String clamp 40 of combination unit 12 is manually displaced upwards towards the first string to be tensioned until the string is between open gripping jaws 52 of string clamp 40.

9. Clamp actuating lever 54 of string clamp 40 is then operated to close gripping jaws 52 upon the first main string.

10. The computer control button 46 designated as "pull" on combination unit 12 is depressed. Combination unit 12 will then automatically draw string clamp 40 until the preset "target" tension, input in step 5 above, is reached. Once "target" tension is reached, combination unit 12 will stop and will hold the string at the target tension.

11. Steps 5 to 10 above are repeated on the remaining main strings using the two combination units 12 alternately until all the main strings are tensioned to target tension.

12. Finally, after all main strings have been tensioned, the length of string used to compose the main strings is tied off at the racquet head frame.

13. Once all main strings have been loosely installed and then subsequently tensioned, the cross string installation and tensioning process is similarly accomplished. First, a new piece of string of sufficient length to compose the cross strings is tied off at the frame at the cross string starting point. Then, all cross (horizontal) strings are threaded loosely into racquet head frame 28. Between the first cross string and the second cross string, approximately 12 inches of string is left outside racquet head frame 28 in a loop that will be used to pretension the string in subsequent steps with pretensioner 48. Between every succeeding cross string woven through racquet head frame 28, a length of string approximately 2 inches long is left in a loop outside racquet head frame 28 for pretensioning purposes.

14. Steps 5 to 8 are now repeated for each cross string, with the addition of step 15.

15. The string loop left outside racquet head frame 28 at the end of each cross string in step 13 above is clamped in pretensioner 48 and tensioned to approximately 75% of target tension by operating pretensioner control switch 60, prior to final tensioning as in steps 9 through 11.

16. Finally, after tensioning all cross strings, the length of string used to compose the cross string bed is tied off securely close to racquet head frame 28.

Conclusion, Ramifications, and Scope of Invention

Due to the synergy of the design herein described, significant gains in all areas of stringing efficiency can now be simultaneously achieved. The new tensioning and clamping system design both improves tension accuracy and eliminates string overstress. The non-rotating racquet system provides improvements in working accessibility, more efficient mounting, and simplified string installation all aid operator efficiency and speed. Finally, the present invention can be operated as a portable machine without losing any of its effectiveness. These improvements are integrated to create a system that produces better quality string jobs and makes racquet stringing easier and faster than ever before. Stringing time is potentially reduced to the point that a "string-while-you-wait" service for the retail customer becomes practical for the first time. Numerous advantages for the retailer result, including keeping the customer browsing in the shop while waiting. Marketing success for the invention is enhanced by such customer and retailer-pleasing features.

While the above description contains many specificities, these should not be construed as limitations on the scope of the invention, but rather as an exemplification of one preferred embodiment thereof. Many other variations are possible including the use of a single combination unit 12 with a passive clamp 86. This patent is intended to cover all possible variations on the direct tensioning unit/non-rotating racquet operating principle. Actual ramifications include the following:

1. Pneumatic, hydraulic, dropweight, spring and manual powered linear actuators.

2. String tension control by means of varying driver force instead of tension sensing and feedback. For example, air or fluid pressure metered to a pneumatic or hydraulic linear actuator to produce different string tensions.

3. Various means for positioning and fixing combination tensioning and clamping units relative to racquet head frame holding fixture, including: dovetail and T-slot retentive tracks in a ring, holes in a ring for the demountable positioning of combination tensioning and holding clamp units, and combination tensioning and holding clamp units with clamps to attach units to ring.

4. The non-rotating/direct tensioning system also is the best foundation for auto threading and tensioning by means of completely automated combination tensioning and holding clamp units or robotic articulated arms, i.e., a robotic stringing machine.

5. Combination tensioning and holding clamp units comprised of servomotor-driven linear actuators controlled by an analog feedback loop.

6. A further potential embodiment of the present invention would be a modification of existing machines wherein the conventional passive holding clamps would be modified to sense actual tension in the string and allow for the adjustment of that tension by the movement of the clamp. In this conversion scheme, the conventional rotating cradle structure would prevent such a hybrid machine from having the improved accessibility of the present invention, and is therefore not the preferred embodiment; however, significant gains in tension accuracy would be achieved by the adoption of the present invention's direct tensioning feature.

7. Another potential embodiment of the present invention would be a machine consisting of a non-rotating racquet head frame holding fixture used in combination with a conventional passive clamp system. In such a machine, tensioning would be accomplished either by an external tensioner movable relative to the ring, or by a fixed external tensioner combined with a movable roller. In this embodiment, the accessibility advantages of the favored embodiment would be gained but the tension accuracy of the favored embodiment would be lost.

Many embodiments of the intent and spirit of the present invention are therefore possible. Accordingly, the scope of the invention should not be determined by the embodiments illustrated, but by the appended claims and their legal equivalents.

I claim:

1. An apparatus for installing strings in racquets, comprising: one or more combination tensioning and holding clamp units, each having means for drawing a string to a desired tension and for holding said string at said desired tension, and said combination tensioning and holding clamp units operating inside the open area of a racquet head frame directly on the length of string being installed; and means for fixing said combination tensioning and holding clamp units at any position relative to said racquet head frame.

2. An apparatus for installing strings in racquets, comprising:

two or more clamp units including at least one combination tensioning and holding clamp units, said combination tensioning and holding clamp unit having means for drawing a string to a desired tension and for holding said string at said desired tension, said clamp units operating inside the open area of a racquet head frame directly on the length of string being installed; and means for fixing said clamp units at any position relative to said racquet head frame.

3. The apparatus of claim 2, wherein the clamp units are combination tensioning and holding clamp units.

4. The apparatus of claim 2, further including a fixed, non-rotating racquet head frame holding fixture.

5. The apparatus of claim 2, wherein said combination tensioning and holding clamp unit comprises:

(a), a string clamp;

(b), an electro-mechanical linear actuator driving means for driving said string clamp; and (c), strain transducer means for electronic sensing of tension level in a string; and further including an embedded digital microcomputer system which controls said electro-mechanical linear actuator driving means in response to operator inputs and feedback from said strain transducer means; and wherein said fixed, non-rotating racquet head frame holding fixture is in the form of a ring circumscribing said racquet head frame; and wherein said ring has a retentive track in its underside; and further including means for engaging said combination tensioning and holding clamp units to said retentive track so as to enable the units to be freely moved and firmly clamped at any position along said track.

6. An apparatus for installing strings in racquets, comprising: a fixed, non-rotating racquet head frame holding fixture; and means for tensioning and holding a string, wherein said means for tensioning and holding a string comprises one or more combination tensioning and holding clamp units, each having means for drawing a string to a desired tension and for holding said string at said desired tension, and said combination tensioning and holding clamp units operating inside the open area of a racquet head frame directly on the length of string being installed.

7. The apparatus of claim 6, wherein said fixed, non-rotating racquet head frame holding fixture is substantially planar in form.

8. The apparatus of claim 6, wherein said fixed, non-rotating racquet head frame holding fixture is in the form of a ring.

9. The apparatus of claim 8, further including means for engaging or interlocking said combination tensioning and holding clamp units to said ring so as to enable said units to be freely moved and firmly clamped at any position along the circumference of said ring.

10. An apparatus for installing strings in racquets comprising:

a racquet head frame holding fixture including a plurality of racquet head frame engaging and supporting members disposed along the outer perimeter of a racquet head frame space; and means for tensioning and holding said strings, wherein said means includes an electromechanical linear actuator.

11. The apparatus of claim 10, wherein said means for tensioning and holding said strings further comprises one or more combination tensioning and holding clamp units, each having means for drawing a string to a desired tension and for holding said string at said desired tension, and said combination tensioning and holding clamp units operating inside the racquet head frame space directly on the length of string being installed.

12. The apparatus of claim 11, further including a fixed, non-rotating racquet head frame holding fixture.

13. An apparatus for installing strings in racquets, comprising: a pedestal structure comprising a column support and a counterweight that is offset to one side of the column support so as to stabilize the apparatus against tipping; and a racquet supporting structure fixed to said pedestal and including means for tensioning and holding a string, whereby the floor area directly beneath the racquet stringing structure is substantially devoid of pedestal structure so as to accommodate a sitting human.

14. The apparatus of claim 13, wherein said pedestal is T-shaped.

15. The apparatus of claim 13, wherein said means for tensioning and holding a string comprises one or more combination tensioning and holding clamp units, each having means for drawing a string to a desired tension and for holding said string at said desired tension, and said combination tensioning and holding clamp units operating inside the open area of a racquet head frame directly on the length of string being installed; and means for fixing said combination tensioning and hold clamp units at any position relative to said racquet head frame.

* * * * *